US005546291A

United States Patent [19]

Simes

[11] Patent Number: 5,546,291

[45] Date of Patent: Aug. 13, 1996

[54] CONVERSION KIT ASSEMBLY FOR A LIGHT BULB

[76] Inventor: David P. Simes, 19046 Vicci St., Santa Clarita, Calif. 91351

[21] Appl. No.: 362,817

[22] Filed: Dec. 22, 1994

[51] Int. Cl.[6] ..... F21S 3/00

[52] U.S. Cl. ..... 362/223; 362/260; 313/318.01

[58] Field of Search ..... 362/223, 311, 362/260, 263; 313/318.01, 318.12

[56] References Cited

U.S. PATENT DOCUMENTS

| | | | |
|---|---|---|---|
| 1,042,979 | 10/1912 | Seessle | 362/444 |
| 4,763,233 | 8/1988 | Poyer | 362/260 |
| 4,841,419 | 6/1989 | Ohishi | 313/318.01 |
| 5,073,845 | 12/1991 | Aubrey | 362/260 |

*Primary Examiner*—Denise L. Gromada

*Attorney, Agent, or Firm*—Loeb & Loeb LLP

[57] ABSTRACT

A conversion kit assembly for use with a light bulb such as a compact fluorescent bulb provides the light bulb with the appearance of a different type of bulb as well as the ability to adjust the illumination by varying the position of the conversion kit assembly on the light bulb. The conversion kit assembly includes a collar having a hollow interior for receiving the light bulb and resilient prongs for engaging the light bulb to maintain the collar in a desired mounted position on the light bulb. The resilient prongs can comprise wire loops formed at the opposite ends of a length of wire mounted within the collar, or leaf springs mounted within the hollow interior of the collar. A threaded base of the collar releasably receives the threaded base of a glass envelope having a hollow interior for receiving a portion of the light bulb mounted within the collar. The glass envelope has the shape and appearance of a particular type of light bulb, so that a compact fluorescent bulb can assume the appearance of a floodlight, a spotlight or a rounded globe.

9 Claims, 7 Drawing Sheets

CONVERSION KIT ASSEMBLY FOR A LIGHT BULB

BACKGROUND OF THE INVENTION

1. Field of the Invention

The present invention relates to lamp assemblies for light bulbs, and more particularly to a removable assembly for providing a light bulb with the appearance of a different type of light bulb.

2. History of the Prior Art

It is known in the art to provide a light bulb with a removable assembly so that the light bulb takes on the appearance of a different type of light bulb. Such assemblies may be used, for example, in the case of certain low power bulbs which have become popular in recent years.

Examples of low power bulbs, which have become popular because of their energy saving, include compact fluorescent bulbs. Such bulbs are capable of producing the illumination equivalent of an incandescent bulb having several times their power consumption. Examples of compact fluorescent bulbs include the "Dulux EL", manufactured by Osram Sylvania Inc. of Maybrook, N.Y. Such bulbs are presently available in 7-, 11-, 15-, 18-, 20-, 23-, 25-, 28-, 30- and 32-watt sizes. The 11-watt bulb produces 600 lumens of lumination, as compared with 445 lumens produced by a 40-watt incandescent bulb. Moreover, the 11-watt compact fluorescent bulb typically has a life of 10,000 hours, compared with a 1500-hour life for the incandescent bulb.

Compact fluorescent bulbs therefore represents a tremendous savings in energy costs over the life of the bulbs. However, such bulbs do not always provide a desired or acceptable appearance. In the case of ceiling lights which are mounted in recessed cans, for example, such applications have traditionally utilized floodlights or spotlights to provide a desired appearance in addition to the desired illumination and light distribution pattern. Substitution of compact fluorescent bulbs for floodlight or spotlight bulbs may provide the desired amount of illumination with considerably less power, but at the expense of appearance. For such applications, it would be desirable to provide a removable conversion kit assembly for providing the compact fluorescent bulbs with the desired floodlight, spotlight or other desired appearance. Also, it would be advantageous to provide a conversion kit assembly capable of adjusting the amount of illumination in an easy and simple manner.

Heretofore, it has been known to employ a glass envelope in conjunction with various light bulb arrangements. Thus, it is known to mount an adapter in a ballast or a socket, with a light bulb then being attached to the adapter. A glass envelope is then mounted, such as on the ballast, so as to enclose the lamp and provide the resulting arrangement with a desired appearance. When the lamp burns out, it can be replaced without replacing the adapter which contains the electronic power source. In spite of the economies involved, however, such arrangements have given way to a single, integral compact fluorescent bulb which is simply thrown away and replaced when it burns out.

The compact fluorescent bulbs are particularly attractive as an alternative light source because of their low power consumption, as previously noted. They are particularly attractive in mass lighting situations, such as for use with multiple ceiling lights in both commercial and residential applications. However, the use of such compact fluorescent bulbs results in a less than pleasing, if not unacceptable, appearance in such applications where floodlights or spotlights are typically used.

For this reason, and as previously noted, it would be desirable to provide removable conversion kit assemblies for light bulbs such as compact fluorescent bulbs so that a desired appearance can be achieved in addition to the advantages of low power consumption and long life provided by such bulbs. In addition, it would be desirable to provide such a conversion kit assembly with the ability to adjust the amount of illumination. Such a conversion kit assembly should interface with the light bulb in such a way as to permit the entire assembly to be installed in and removed from a recessed can fixture or other typical ceiling light fixture using a suction lamp changer from the floor.

BRIEF DESCRIPTION OF THE INVENTION

The foregoing and other objects are accomplished in accordance with the invention by a conversion kit assembly which is removably attached to a compact fluorescent bulb or other light bulb so as to provide the appearance of a desired type of light bulb, such as a floodlight, a spotlight or a circular globe. At the same time, the conversion kit assembly securely couples to the light bulb to permit installation and removal of the light bulb in a receptacle, such as through use of a suction lamp changer from the floor, with the conversion kit assembly attached to the light bulb. In a preferred embodiment, as described hereafter, the conversion kit assembly is also adjustably positioned relative to the length of the light bulb so as to vary the amount of illumination.

Conversion kit assemblies according to the invention include a glass envelope having a hollow interior for receiving at least a portion of the light bulb, together with a collar engaging the light bulb and coupled to the glass envelope to mount the glass envelope on the light bulb. The collar has a hollow interior in which the light bulb resides and a plurality of resilient prongs engaging the light bulb. A threaded base on the collar receives a threaded base of the glass envelope to releasable couple the glass envelope to the collar. The glass envelope has the shape and appearance of a particular type of light bulb. The collar may be of generally cylindrical configuration.

The resilient prongs of the collar may comprise an opposite pair of resilient elements extending out of the body of the collar from opposite sides of the hollow interior so as to resiliently engage the base of the light bulb. The resilient elements preferably have outer peripheral portions outside of the body which are angled toward each other to enhance the resilient engagement of the base of the light bulb thereby.

In a preferred embodiment of a collar according to the invention, the pair of resilient elements comprise wire loops. Such loops may be formed at the opposite ends of a length of wire mounted within the hollow interior of the body, and permit adjustable positioning of the collar relative to the base of the light bulb. This varies the extent to which the light bulb extends into the glass envelope, and thus the amount of illumination passing through the glass envelope from the light bulb.

In an alternative embodiment, the pair of resilient elements comprise leaf springs.

BRIEF DESCRIPTION OF THE DRAWINGS

A better understanding of the invention may be had by reference to the following specification in conjunction with the accompanying drawings, in which.

DETAILED DESCRIPTION

Figure 1:
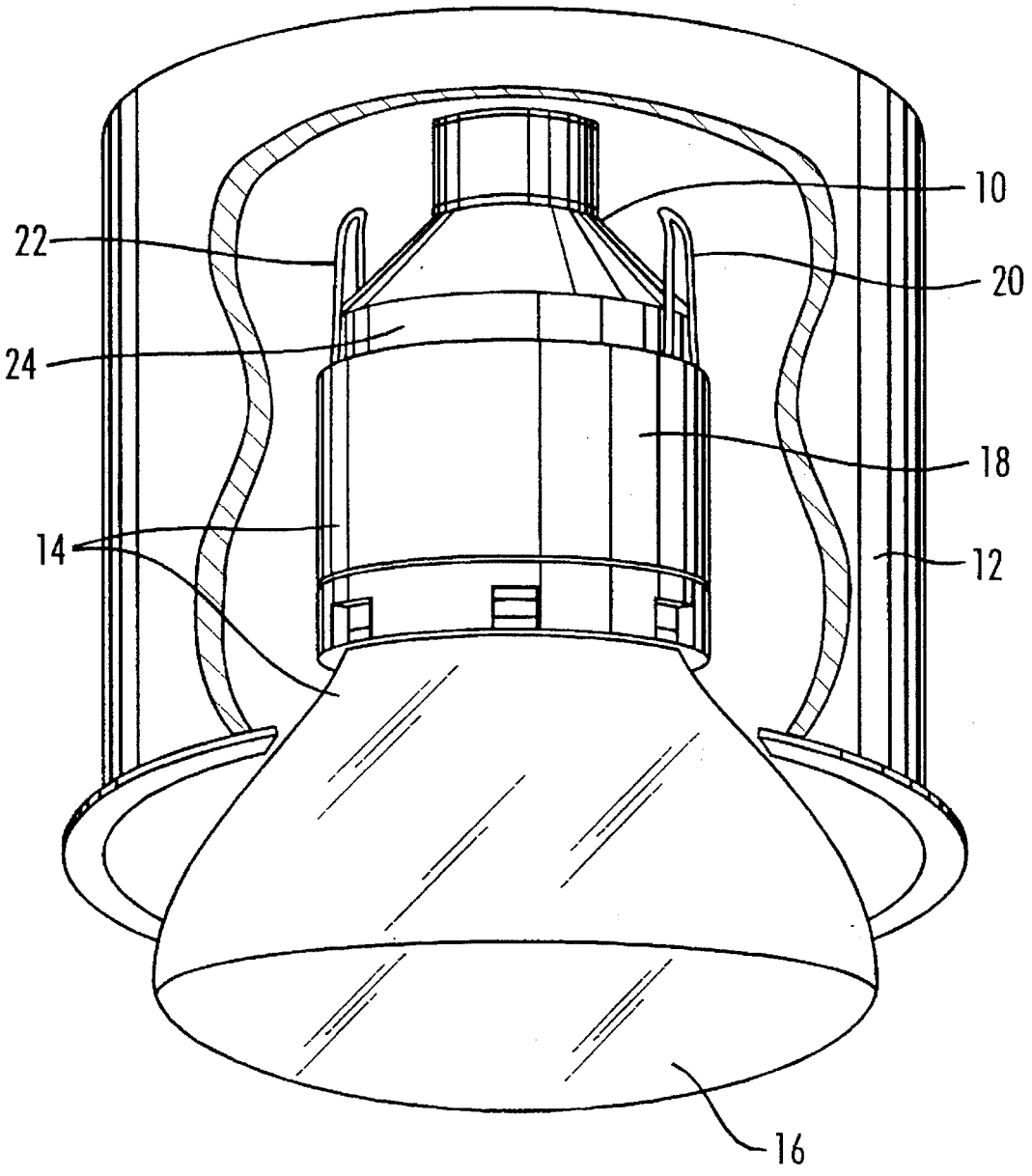
FIG. 1 is a perspective view, partly broken away, of a compact fluorescent light bulb mounted in a recessed can fixture and having a conversion kit assembly mounted thereon in accordance with the invention.
Figure 2:
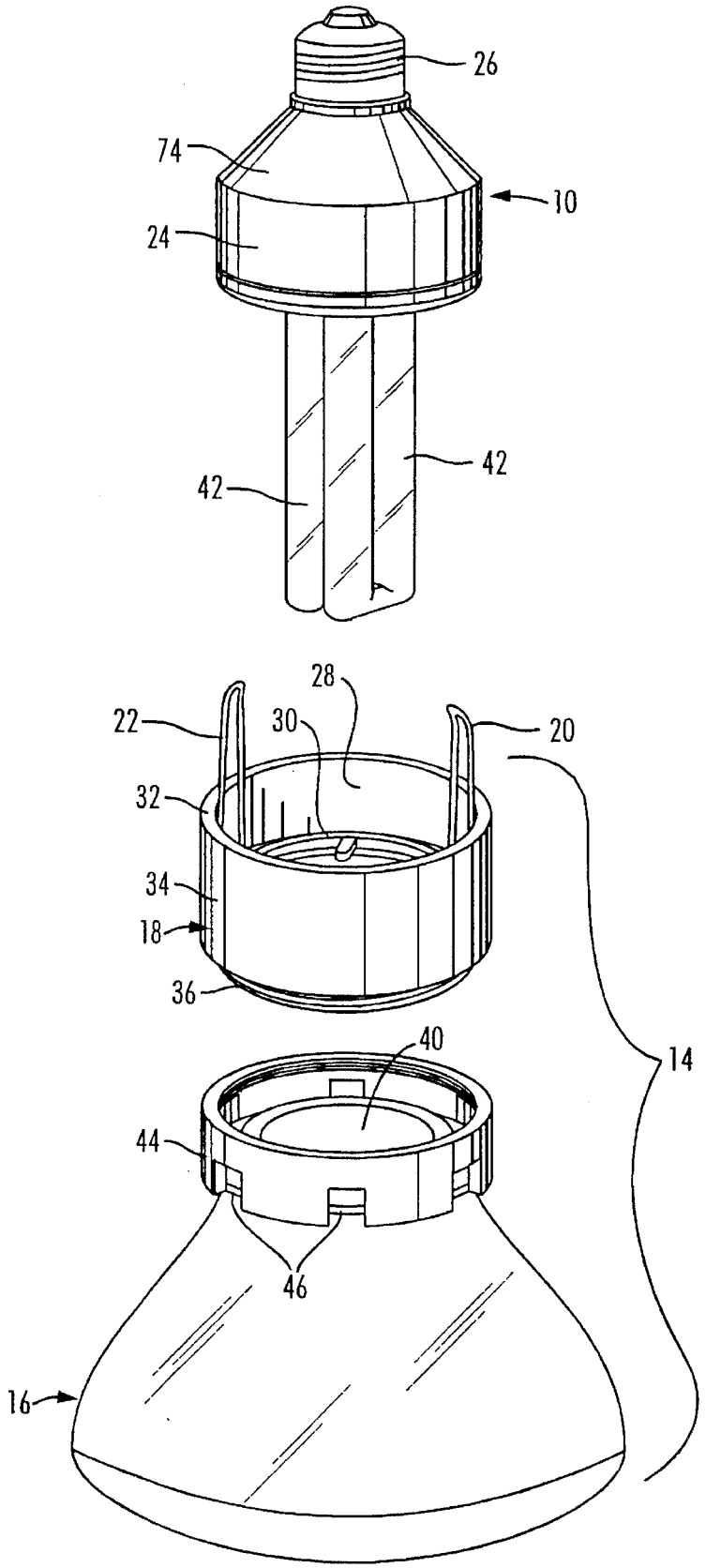
FIG. 2 is an exploded perspective view of the compact fluorescent light bulb of FIG. 1 together with the collar and glass envelope comprising the conversion kit assembly of FIG. 1.
Figure 3:
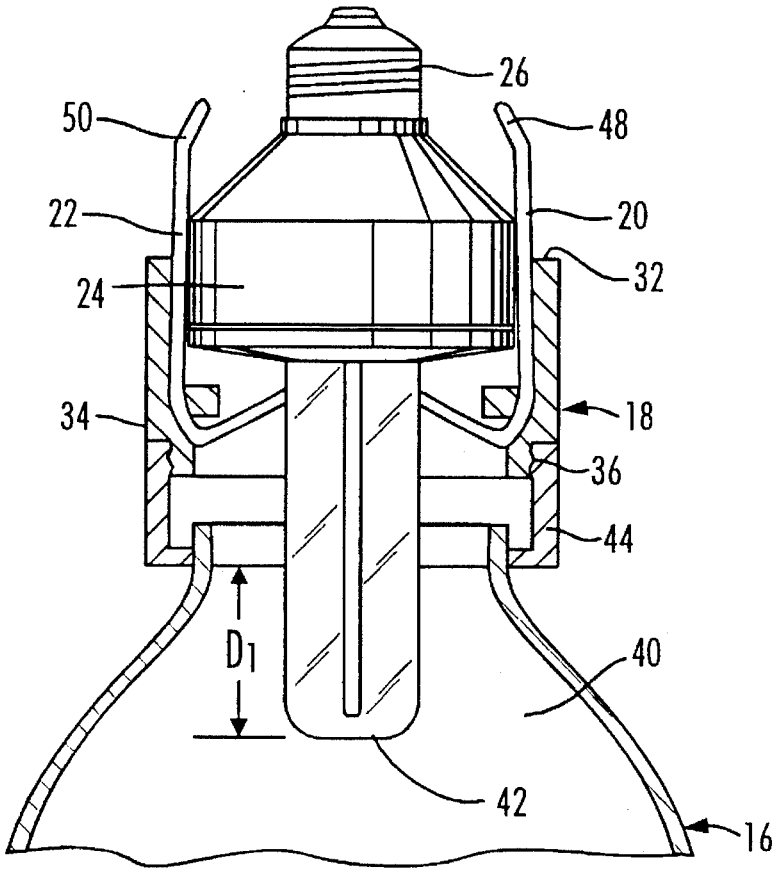
FIG. 3 is a partial sectional view of a portion of FIG. 1, and showing a first position of the collar on the bulb so as to provide a first amount of illumination through the glass envelope.
Figure 4:
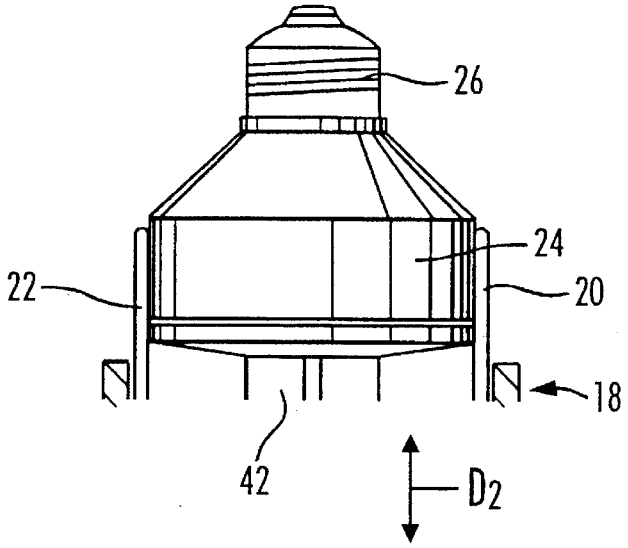
FIG. 4 is a partial sectional view similar to that of FIG. 3 but with the collar in a second position on the light bulb so as to provide a reduced second amount of illumination through the glass envelope.

FIG. 1 shows a light bulb 10, such as a compact fluorescent light bulb, mounted in a socket within a recessed can fixture 12. The light bulb 10, which is shown in detail in FIGS. 2–4, is essentially hidden from view from the outside of the recessed can fixture 12 by a conversion kit assembly 14 in accordance with the invention. The conversion kit assembly 14 includes a hollow glass envelope 16 into which the light bulb 10 at least partially extends, as described hereafter. The glass envelope 16 comprises essentially all of what is seen from the outside of the recessed can fixture 12 and has the shape and appearance of a desired light bulb, such as a floodlight in the example of FIG. 1. The glass envelope 16 is removably attached to a collar 18 which is attached to the light bulb 10 and which forms a part of the conversion kit assembly 14. The collar 18 has a hollow interior in which the light bulb 10 is resiliently secured by a plurality of resilient prongs. In the example of FIG. 1, the resilient prongs comprise a pair of resilient elements in the form of opposite wire loops 20 and 22. The wire loops 20 and 22 extend upwardly from a hollow interior of the collar 18 and bear against a base 24 of the light bulb 10 so as to secure the collar 18 in a desired position on the light bulb 10.

As shown in FIG. 2, the light bulb 10 is of the compact fluorescent type, having a threaded portion 26 of the generally cylindrical base 24 for securing within a mating socket in the recessed can fixture 12, or other light fixture. The recessed can fixture 12 is shown in FIG. 1, and hereafter, by way of example only, and it will be understood by those skilled in the art that conversion kit assemblies in accordance with the invention can be used in conjunction with a light bulb mounted in other lamp environments.

As shown in FIG. 2, the collar 18 is of generally cylindrical configuration so as to have a hollow interior 28 which is large enough to accommodate the base 24 of the light bulb 10. The wire loops 20 and 22 extend upwardly from opposite sides of the hollow interior 28, and in the present example are formed from a single length of wire 30 as described in detail hereafter in connection with FIG. 5. The wire loops 20 and 22 extend out of an upper end 32 of a body 34 of the collar 18. An opposite lower end 36 of the body 34 forms a threaded base for releasably receiving the glass envelope 16.

As shown in FIG. 2, the glass envelope 16 has a hollow interior 40 for receiving a portion of the light bulb 10. The compact fluorescent bulb, comprising the light bulb 10, has U-shaped tubes 42 extending from the base 24. With the collar 18 mounted on the base 24, and the glass envelope 16 coupled to the collar 18, the U-shaped tubes 42 of the light bulb 10 extend into the hollow interior 40 of the glass envelope 16. The glass envelope 16 is coupled to the collar 18 by a threaded circular base 44 thereof which is provided with spaced-apart apertures 46 to vent the hollow interior 40 of the glass envelope 16. The threaded circular base 44 of the glass envelope 16 is simply screwed onto the threaded base 36 of the collar 18 to releasably couple the glass envelope 16 to the collar 18.

FIG. 3 shows the light bulb 10 with the collar 18 mounted thereon in a first position. With the collar 18 in the first position as shown, the upper end 32 of the body 34 of the collar 18 extends part way up the sides of the base 24 of the light bulb 10. The opposite wire loops 20 and 22 extend all the way up the sides of the base 24 and terminate in outer peripheral portions 48 and 50, respectively, which are angled slightly toward each other so as to form small angles with the principal portions of the wire loops 20 and 22.

In the position shown in FIG. 3, the U-shaped tubes 42 of the light bulb 10 extend into the hollow interior 40 of the glass envelope 16 by a first distance $D_1$, to provide a first amount of illumination through the glass envelope 16.

FIG. 4 is a view similar to that of FIG. 3, but illustrating the collar 18 in a second position relative to the light bulb 10. In the second position shown in FIG. 4, the collar 18 is in a lower position than in the case of FIG. 3, and is retained on the base 24 of the light bulb 10 almost entirely by action of the opposite wire loops 20 and 22. In the position shown in FIG. 4, the U-shaped tubes 42 of the light bulb 10 extend into the hollow interior 40 of the glass envelope 16 by a second distance $D_2$ which is less than the first distance $D_1$ shown in FIG. 3. Consequently, even though the light bulb 10 continues to produce the same total amount of illumination, less illumination passes through the glass envelope 16 in the case of the second position of FIG. 4 because of the lesser penetration of the light bulb 10 into the hollow interior 40 of the glass envelope 16.

The resilient engagement of the light bulb 10, as provided by the wire loops 20 and 22 of the collar 18, allows for a range of different possible positions of the collar 18 and thus the glass envelope 16 relative to the light bulb 10, while at the same time ensuring that the collar 18 is securely mounted on the base 24 of the light bulb 10. In this fashion, the glass envelope 16 can be positioned relative to the light bulb 10 to vary the amount of illumination provided by the glass envelope 16, in an easy and simple way.

Figure 5:
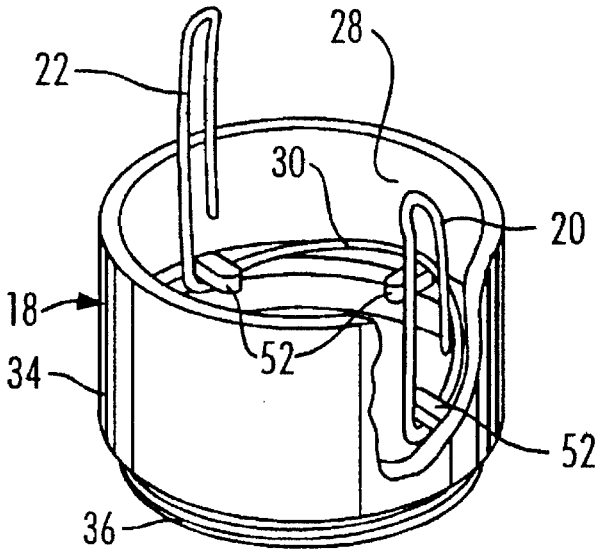
FIG. 5 is an enlarged, detailed and partly broken away perspective view of the preferred embodiment of the collar as shown in FIGS. 1–4.

FIG. 5 shows the preferred embodiment of the collar 18 in greater detail. As shown in FIG. 5, the hollow interior 28 of the collar 18 is provided with a plurality of inwardlyextending, spaced-apart tabs 52. The wire loops 20 and 22 are provided by the opposite ends of the length of wire 30. At the lower ends of the opposite wire loops 20 and 22, the length of wire 30 extends under opposite ones of the tabs 52 before forming a central portion of the length of wire 30 which resides over an intermediate third one of the tabs 52. Such arrangement has been found to provide a convenient configuration for manufacture of the collar 18 and installation of the length of wire 30 therein so as to form the opposite wire loops 20 and 22.

Figure 6:
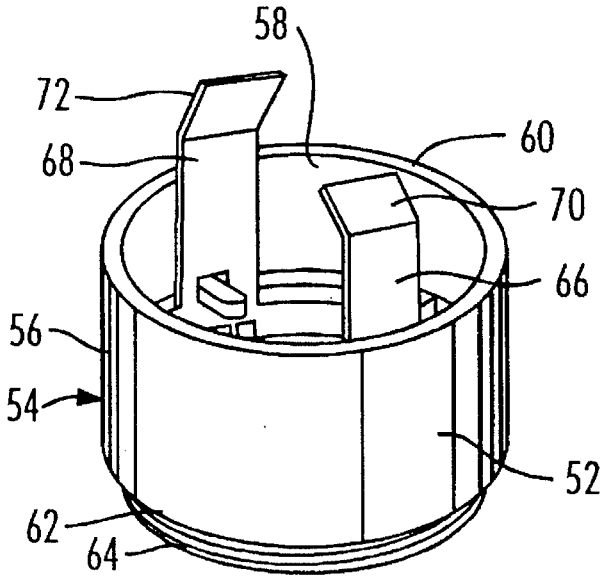
FIG. 6 is a perspective view of an alternative embodiment of the collar.

FIG. 6 shows an alternative embodiment of a collar 54. As in the case of the collar 18, the collar 54 has a body 56 of cylindrical configuration having a hollow interior 58. The body 56 has opposite upper and lower ends 60 and 62, respectively, with the lower end 62 forming a threaded base 64 for receipt of the threaded circular base 44 of the glass envelope 16. Like the collar 18 of FIG. 5, the collar 54 of FIG. 6 includes a plurality of resilient prongs comprising a pair of resilient elements extending out of the body 56 above the upper end 60 thereof from the hollow interior 58. In the collar 54 of FIG. 6, however, the resilient elements comprise opposite leaf springs 66 and 68 coupled to the collar 54 at lower portions of the hollow interior 58 thereof. As in the case of the wire loops 20 and 22 of FIG. 5, the leaf springs 66 and 68 have outer peripheral portions 70 and 72, respectively, which are angled toward each other. However, the outer peripheral portions 70 and 72 form much larger angles with the main portions of the leaf springs 66 and 68, so as to conform to a beveled portion 74 of the base 24 of the light bulb 10 (shown in FIG. 2). For this reason, the collar 54 of FIG. 6 is designed to assume one position when mounted on the light bulb 10, and is not readily movable along the length of the light bulb 10 so as to vary the amount of illumination passing through the glass envelope 16, as in the case of the collar 18 of FIG. 5.

It will be apparent to those skilled in that art that other arrangements of the resilient elements are possible, in addition to those shown in FIGS. 5 and 6. For example, a length of wire can be mounted on the outside of the collar at the lower end adjacent the threaded base so that the opposite ends thereof extend upwardly along opposite sides of the outside of the collar and form wire loops above the upper end of the collar for engaging the base of the bulb. Alternatively, resilient elements can be formed as part of the collar when the collar is molded.

Figure 7:
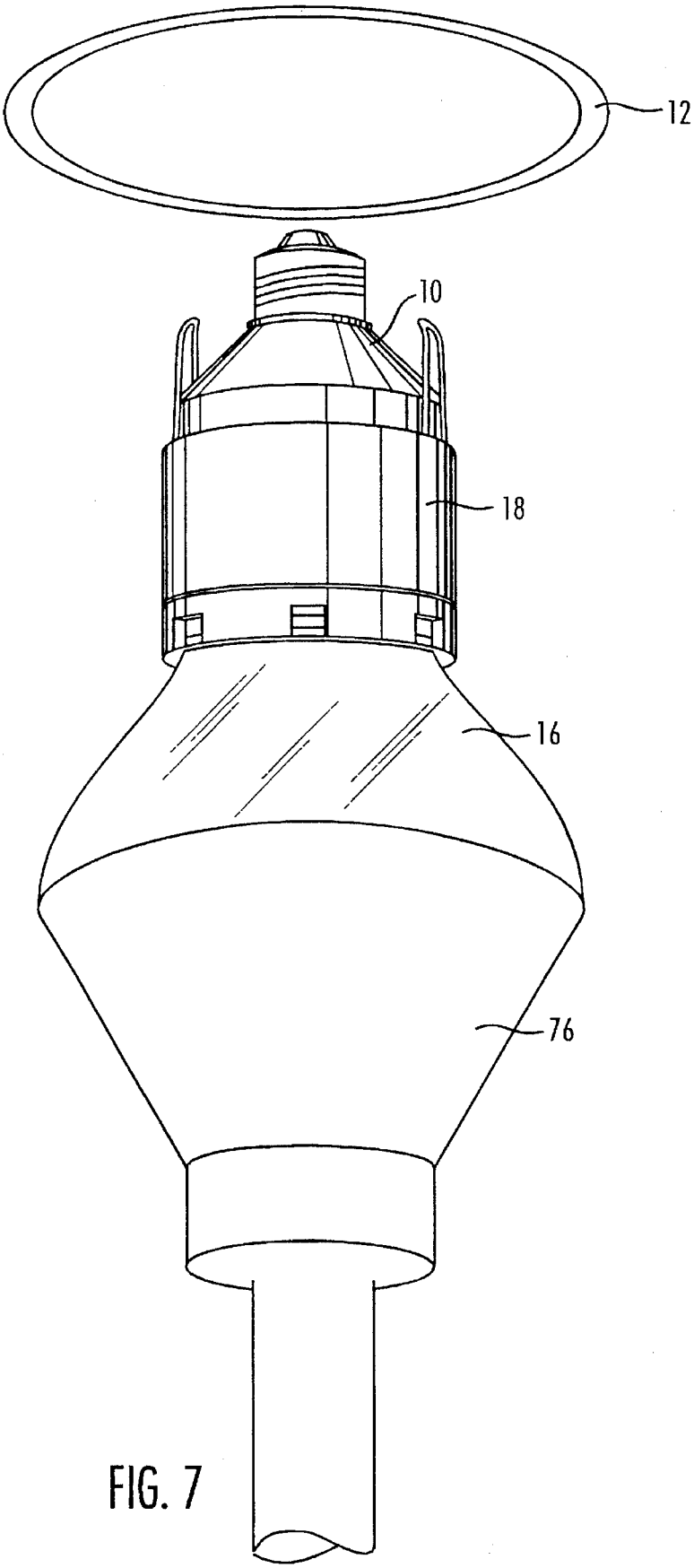
FIG. 7 is a perspective view of the light bulb with attached conversion kit assembly, as in FIG. 1, and illustrating the manner in which the bulb-conversion kit assembly combination can be installed in and removed from the recessed can fixture using a conventional suction lamp changer from the floor.

FIG. 7 shows the collar 18 mounted on the light bulb 10, and with the glass envelope 16 coupled to the collar 18. FIG. 7 illustrates the ease with which the combined light bulb 10 and the conversion kit assembly including the collar 18 and the glass envelope 16 can be installed in and removed from a light fixture such as the recessed can fixture 12, such as by use of a suction lamp changer 76. The suction lamp changer 76 is of the type used by an individual standing on the floor below when installing light bulbs in ceiling fixtures at substantial heights. The substantial resilient engagement of the light bulb 10 by the wire loops 20 and 22 of the collar 18 prevents turning of the collar 18 and the glass envelope 16 relative to the light bulb 10, as the light bulb 10 is screwed into and out of the recessed can fixture 12. At the same time, however, the resilient coupling of the collar 18 to the light bulb 10, as provided by the wire loops 20 and 22, permits adjustment of the position of the collar 18 relative to the light bulb 10 to vary the illumination, as well as removal of the collar 18 from the light bulb 10.

As previously noted, the glass envelope 16 may be designed to have the shape and appearance of a particular type of light bulb. FIG. 18 shows an example of a glass envelope 78 which has the shape and appearance of a typical floodlight. When mounted on the light bulb 10 by the collar 18, or the alternative collar 54, the glass envelope 78 provides the resulting assembly with the appearance of a floodlight.

Figure 9:
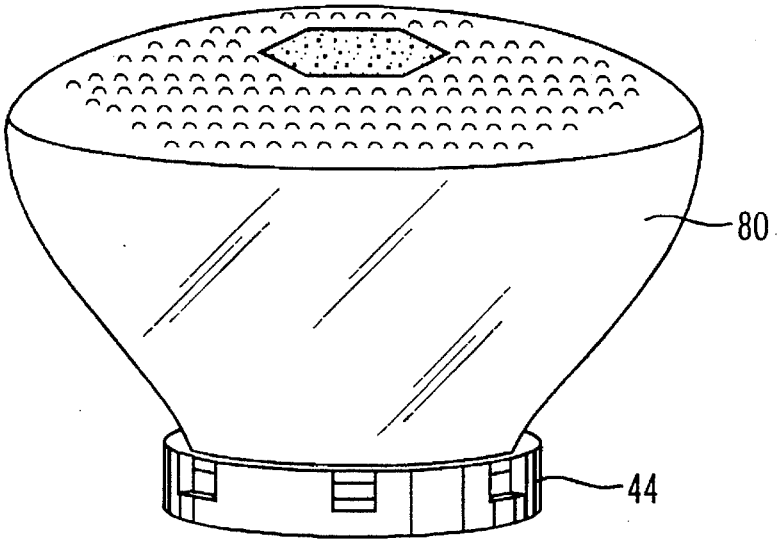
FIG. 9 is a perspective view of a glass envelope having the shape and appearance of a spotlight.

FIG. 9 shows a glass envelope 80 which has the shape and appearance of a spotlight. When mounted on the light bulb 10 by the collar 18 or the alternative collar 54, the resulting arrangement has the appearance of a spotlight.

Figure 10:
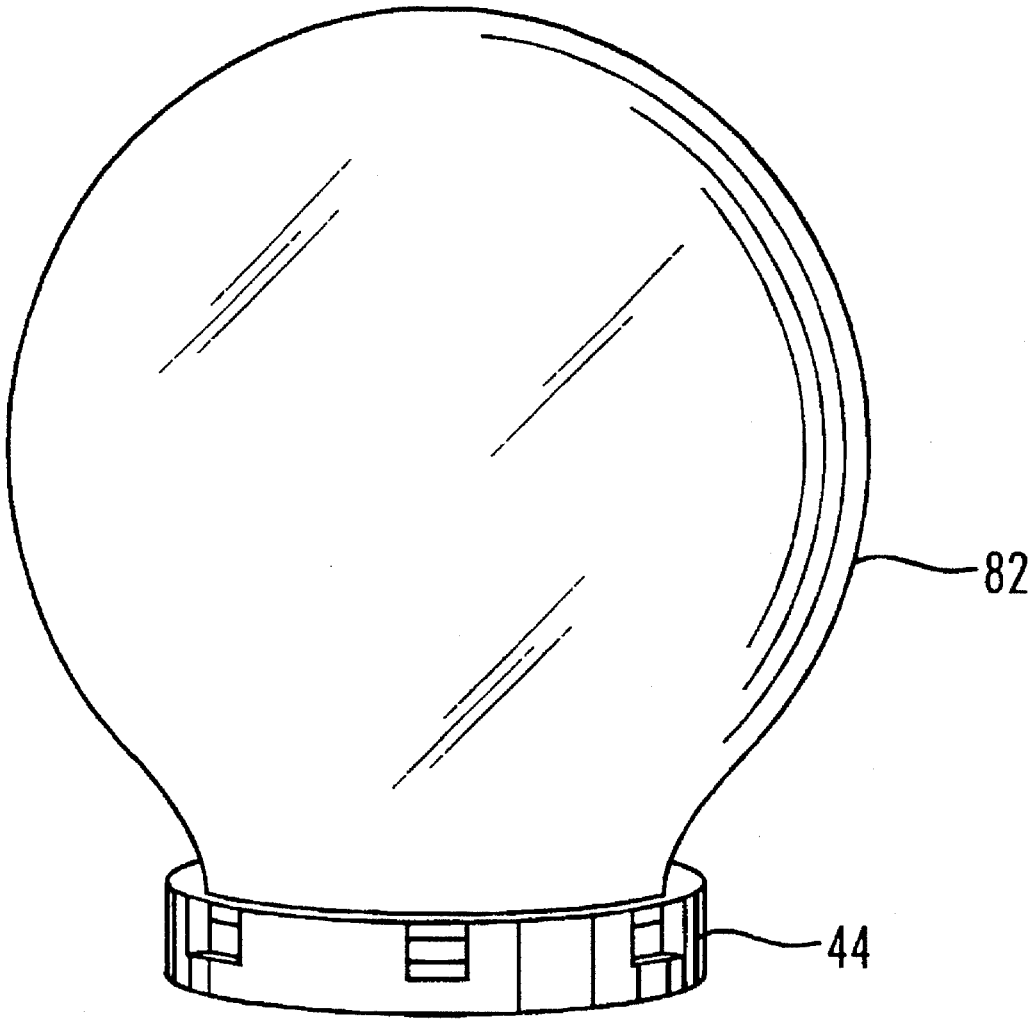
FIG. 10 is a perspective view of a glass envelope having the shape and appearance of a rounded globe.

FIG. 10 shows a glass envelope 82 having the shape and appearance of a rounded globe. Consequently, the resulting combination of the glass envelope 82 with the collar 18, or the alternative collar 54, and the light bulb 10, has such appearance.

Figure 8:
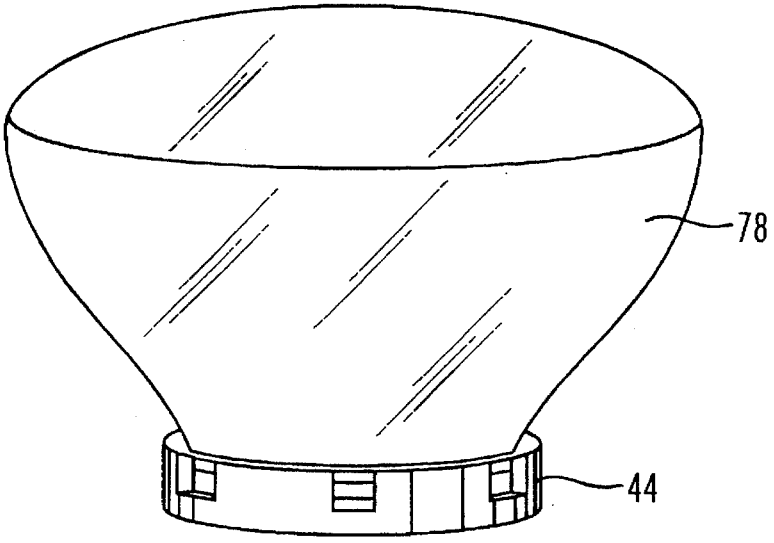
FIG. 8 is a perspective view of a glass envelope having the shape and appearance of a floodlight.

The glass envelopes 78, 80 and 82 of FIGS. 8, 9 and 10, respectively, are provided with the threaded circular base 44 for releasably securing to the threaded base 38 of the collar 18 or the threaded base 64 of the collar 54.

The glass envelope examples of FIGS. 8, 9 and 10 are provided by way of example only, and it will be apparent that other light bulb shapes and appearances are possible. The glass envelopes can be made of clear glass, white glass or other colors, as desired. Where desired, the glass envelope may be configured to provide a lens effect so that even greater illumination is provided.

While the invention has been particularly shown and described with reference to preferred embodiments thereof, it will be understood by those skilled in the art that various changes in form and details may be made therein without departing from the spirit and scope of the invention.

What is claimed is:

1. A lamp assembly comprising the combination of:

a glass envelope having a hollow interior and a base member at an open end thereof;

a light bulb extending at least partly into the hollow interior of the glass envelope from the open end thereof; and a collar engaging the light bulb and coupled to the base member of the glass envelope to mount the glass envelope on the light bulb, the collar being disposed outside of the glass envelope and extending from the base member opposite the glass envelope and having a hollow interior in which the light bulb resides and a plurality of resilient prongs engaging the light bulb.

2. A conversion collar for a light bulb comprising the combination of:

a substantially cylindrical body having a hollow interior for receiving a light bulb therein;

a plurality of resilient prongs mounted within the body and extending from a first end of the body for engaging a light bulb received within the hollow interior of the body; and a second end of the body including external retaining means adapted to releasably lock with means on a glass envelope and dispose a light bulb received within the hollow interior of the collar in the glass envelope.

3. A conversion collar in accordance with claim 2, wherein the external retaining means includes a threaded portion of the collar.

4. A conversion collar in accordance with claim 2, wherein the plurality of resilient prongs comprise a pair of resilient elements extending out of the body from opposite sides of the hollow interior.

5. A conversion collar in accordance with claim 4, wherein the pair of resilient elements have outer peripheral portions outside of the body which are angled toward each other.

6. A conversion collar in accordance with claim 4, wherein the pair of resilient elements comprise wire loops.

7. A conversion collar in accordance with claim 6, wherein the wire loops are formed at opposite ends of a length of wire mounted in the hollow interior of the body.

8. A conversion collar in accordance with claim 4, wherein the pair of resilient elements comprise leaf springs.

9. A conversion kit assembly comprising the combination of:

a hollow glass envelope having a base member at an open end thereof; and a collar releasably coupled to the base member of the glass envelope and having a hollow interior for receiving a light bulb to position the light bulb within the glass envelope, the collar being disposed outside of the glass envelope and extending from the base member opposite the glass envelope and including means engaging a light bulb to mount the collar on the light bulb and resilient means for engaging a light bulb to adjustably mount the collar on a light bulb along a length of the light bulb.

* * * * *